United States Patent [19]

Niemi

[11] Patent Number: 4,768,721

[45] Date of Patent: Sep. 6, 1988

[54] GRINDER HOUSING FOR A PRESSURE CHAMBER GRINDER

[75] Inventor: Jouko Niemi, Pirkkala, Finland

[73] Assignee: Oy Finnpulva AB, Finland

[21] Appl. No.: 51,683

[22] PCT Filed: Sep. 12, 1986

[86] PCT No.: PCT/FI86/00097

§ 371 Date: Apr. 30, 1987

§ 102(e) Date: Apr. 30, 1987

[87] PCT Pub. No.: WO87/01617

PCT Pub. Date: Mar. 26, 1987

[30] Foreign Application Priority Data

Sep. 18, 1985 [FI] Finland ..... 853592

[51] Int. Cl.[4] ..... B02C 19/06

[52] U.S. Cl. ..... 241/39; 241/81

[58] Field of Search ..... 241/5, 39, 40, 81

[56] References Cited

U.S. PATENT DOCUMENTS 2,588,945 3/1952 Trost ..... 241/5 X 3,559,895 2/1971 Fay ..... 241/5

4,502,641 3/1985 Coombe ..... 241/5

*Primary Examiner*—Mark Rosenbaum

*Attorney, Agent, or Firm*—McGlew and Tuttle

[57] ABSTRACT

The present invention is concerned with a grinder housing of a pressure chamber grinder, which said grinder housing comprises a substantially cylindrical outer mantle (1), end walls (2, 3), at least two accelerating nozzles (4) passing radially through the outer mantle (1), between which said nozzles there is an obtuse angle, as well as a discharge opening (5) made into one of the end walls (3) for the ground product. The invention is characterized in that the grinder housing is provided with a substantially cylindrical partition wall (6), which is in itself known, centrally located, and which surrounds the grinding chamber (7) proper and is provided with an inlet opening (9) facing the orifice of each accelerating nozzle, preferably terminating at the plane of the inner face of the outer mantle (1), that the annular space surrounding the partition wall (6) is a gas removing chamber (8) to which an exhaust duct (10) passing through the outer mantle is connected for the removal of the excess quantity of working gas discharged out of the solids-working-gas jets of the accelerating nozzles (4) into the gas removing chamber (8).

17 Claims, 2 Drawing Sheets

GRINDER HOUSING FOR A PRESSURE CHAMBER GRINDER

FIELD AND BACKGROUND OF THE INVENTION

The present invention is concerned with the grinder housing of a pressure chamber grinder, in which the grinder housing comprises a substantially cylindrical outer mantle, end walls, preferably two accelerating nozzles passing radially through the outer mantle, between which said nozzles there is an obtuse angle, as well as a discharge opening made into one of the end walls for the ground product.

In the pressure chamber grinder apparatuses known in prior art, the discharge ends of the accelerating nozzles extend into the interior of the grinding chamber, where the material-gas jets rushing out of the nozzles collide against each other at very high speeds so that the material particles in the jets are ground. In the main grinding chamber in the prior-art pressure chamber grinders, the material particles are, in principle, subjected to the grinding effect only once. In the case of materials that are difficult to grind, no satisfactory grinding result can be obtained with one passage through the grinder, but the discharge opening of the grinding chamber is directly connected to a classifier, whose discharge opening for the coarse fraction is directly connected to the grinding chamber, to the collision zone of the material-gas jets.

The solution mentioned above is not fully successful, for, in order that the best possible grinding result should be achieved, the solids content in the material-gas jets colliding against each other must be kept relatively high, whereas, in order that a satisfactory classification result should be obtained, a very large excess quantity of gas is required in the classifier. In order that the material particles should reach an ultrasonic speed in the accelerating nozzles, the solids content in the material-gas jets rushing through the nozzles must be kept relatively low. On the other hand, in principle, the working gas has accomplished its duty by the stage in which the material particles have been accelerated through the nozzles. It has, viz., been noticed that the working gas present in the grinding chamber has mainly a detrimental effect on the grinding process proper.

Moreover, in the grinder apparatuses known in prior art, it is not possible to control the solids contents in the material-gas jets between different stages, but a compromise must be made in the choice of the grinding conditions, which does not yield a fully satisfactory result.

SUMMARY AND OBJECT OF THE INVENTION

The object of the present invention has been to eliminate the drawbacks mentioned above, which has been achieved by means of a grinder housing which is provided with a substantially cylindrical partition wall, which is in itself known, centrally located, and which surrounds the grinding chamber proper and is provided with an inlet opening facing the orifice of each accelerating nozzle, preferably terminating at the plane of the inner face of the outer mantle, that the annular space surrounding the partition wall is a gas removing chamber to which an exhaust duct passing through the outer mantle is connected for the removal of the excess quantity of working gas discharged out of the solids-working-gas jets of the accelerating nozzles into the gas removing chamber.

By means of this solution, it is possible to control the solids contents in the material-gas flows before they rush into the grinding chamber, where the grinding takes place in a highly efficient manner, because in the grinding chamber there are no working-gas flows interfering with the grinding. Moreover, in this grinding chamber of new type, the grinding takes place in two stages, so that the grinding result is considerably more uniform than in the grinder apparatuses used in prior art. The first grinding stage takes place in the middle part of the grinding chamber, where the material particles rushing out of the different accelerating nozzles collide against each other at ultrasonic speed, and the second grinding stage takes place when the material particles that have passed through this first collision zone and that have retained their kinetic energy strike against the partition wall in the grinder housing. Since the quantity of working gas rushing into the grinding chamber can be kept relatively low, it is possible to dimension the grinding chamber so small that most of the kinetic energy of the material particles is still retained at the stage in which they strike against the partition wall. In order that the best classification result should be obtained, the classification must be carried out as an operation completely separate from the grinding process. Excessively large material particles are preferably returned, for example, into the feeding container or possibly feeding funnel of the pressure chamber grinder equipment.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which a preferred embodiment of the invention is illustrated.

DESCRIPTION OF THE PREFERRED EMBODIMENT

Figure 1:
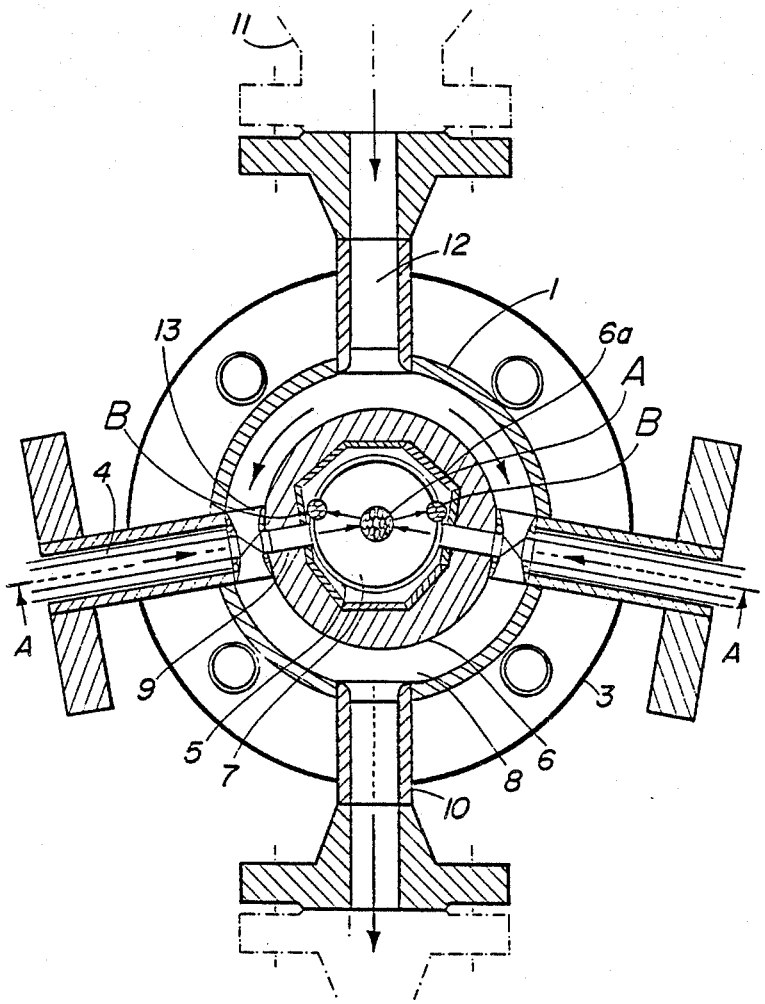
FIG. 1 shows an example of the grinder housing in accordance with the invention as viewed from above.
Figure 2:
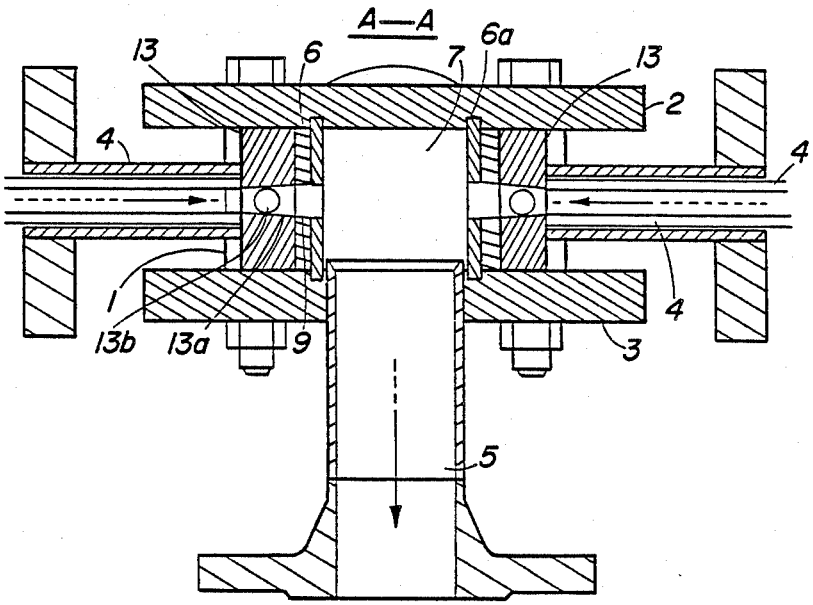
FIG. 2 is a sectional view along line A—A in FIG. 1.

The grinder housing of a pressure chamber grinder in accordance with the present invention comprises a substantially cylindrical outer mantle 1, end walls 2, 3, preferably two accelerating nozzles 4 passing radially through the outer mantle 1, between which said nozzles there is an obtuse angle, and a discharge opening 5 made into one of the end walls 3 for the ground product. In the grinder housing, a substantially cylindrical partition wall 6 is placed centrally, which partition wall divides the grinder housing into a grinding chamber 7 proper and a gas removing chamber 8 surrounding the grinding chamber 7. The accelerating nozzles 4 terminate preferably exactly at the plane of the inner face of the outer mantle 1. Into the partition wall 6, an inlet opening 9 has been made facing the orifice of each accelerating nozzle 4. To the outer mantle 1, a discharge duct 10 is attached for the working gas discharged into the gas removing chamber 8 from the material-gas jets rushing through the accelerating nozzles 4.

The grinder chamber operates so that the pre-ground material-gas jet rushing out of a pressurized pre-grinding chamber is divided into equivalent component jets (not shown), whose number equals the number of the accelerating nozzles 4. These component jets are passed into the said accelerating nozzles 4, wherein the velocity of the jets rises to the ultrasonic level by the effect of the pressure of the working gas. The major part of the quantity of working gas present in the material-gas jet is separated from the said jet in the gap between the orifice of the accelerating nozzle 4 and the inlet opening 9 placed in the partition wall 6 and escapes through the said gap into the gas removing chamber 8, whereby part of the fine fraction in the material-gas jet also follows along. It is only the coarser particles that continue their movement straight into the grinding chamber 7, where, in the first grinding zone A formed in the middle part of the said chamber 7, the said particles collide with the material particles coming from the other accelerating nozzle 4 and are ground. Those particles which, by chance, pass through this grinding zone A without reaching contact with any of the material particles rushing in the opposite direction continue their passage straight forwards and are finally struck against the partition wall 6 in the second grinding zone B formed at the opposite side of the grinding chamber 7. Such a method is possible because the coarser material particles, which require grinding, move along a linear path following the longitudinal axis of the accelerating nozzle 4, and the finer material particles, which correspond to the size of the finished product, move closer to the interior walls of the accelerating nozzles. In order to make sure that the solid particles still have the kinetic energy required for grinding even in the second grinding zone B, the pressure of the working gas in the final part of the accelerating nozzles 4 must be kept at a positive pressure of at least 0.3 bar. Thus, by means of the present grinder housing, it is possible to make sure that all the particles that require grinding indeed become ground.

The size and shape of the inlet openings 9 in the partition wall 10 as well as the size of the grinding chamber 7 itself are chosen in accordance with the properties and composition of the material to be ground as well as in accordance with the properties of the desired final product. If there is a high proportion of fine fraction in the material to be ground, it is possible to use a partition wall 6 with smaller inlet openings 9 than if there is only a very low proportion of fine fraction among the particles. In principle, the size of the grinding chamber 7 should be kept as little as possible, in particular if the material to be ground is of a soft, non-abrasive nature. Instead, if the material to be ground is of highly abrading nature, the grinding chamber should be dimensioned so that most of the grinding of the material takes place in the grinding zone A.

In the discharge duct 10 there is preferably a control valve (not shown), by means of which the quantity of gas removed out of the material-gas jets of the accelerating nozzles 4 through the gas removing chamber 8 is adjusted.

In order to prevent abrasion of the interior face of the partition wall 6 as a result of grinding, the inside of the partition wall 6 is lined with a wear-resistant material, such as ceramic tiles or hard-metal plates 6*a*. The said tiles or plates 6*a* must be installed so that the material particles to be ground collide against their faces substantially perpendicularly.

In order to intensify the removal of working gas, the gas removing chamber 8 in the grinder housing may be advantageously provided with an inlet pipe 12 for flushing air, provided with a control valve 11. In such a case, the control valve placed in the discharge duct 10, mentioned above, can be omitted. The inlet pipe 12 for flushing air and the discharge duct 10 for working gas are preferably installed at opposite sides of the grinder housing in the center plane between the accelerating nozzles 4 so that the inlet pipe 12 is placed at the side of the largest angle between the accelerating nozzles 4. In such a case, the material-gas jets rushing out of the accelerating nozzles 4 turn, by the effect of the flushing air, to a greater extent towards each other so that the grinding effect resulting from the collision is increased.

If, besides working gas, material particles whose particle size is below a certain value are also supposed to be removed from the material-gas jets, it is possible to install flushing-air nozzles 13 between the orifices of the accelerating nozzles 4 and the corresponding inlet openings 9 in the partition wall 6, which said nozzles 13 comprise a first duct 13*a*, substantially following the shape of the flow ducts in the accelerating nozzles 4, for the material-gas jet rushing out of the accelerating nozzle (4), and a second duct 13*b*, having the shape of a venturi tube and passing across the first duct, for the flow of flushing air at the side concerned.

Since most of the working gas contained in the material-gas jets has been passed out of the grinder housing through the discharge duct 10, the discharge opening 5 for ground product in the grinder housing can be connected straight to the receiving and storage container (not shown) for ground product, wherein the remaining part, if any, of the working gas can be separated from the ground product.

In order to exclude the possibility that a particle in the material jet rushing out of one of the accelerating nozzles 4 might penetrate into the opposite accelerating nozzle 4, which is energy-economically highly disadvantageous and, moreover, damages the final part in this accelerating nozzle 4, the obtuse angle between the accelerating nozzles 4 should be kept preferably smaller than 170°.

While a specific embodiment of the invention has been shown and described in detail to illustrate the application of the principles of the invention, it will be understood that the invention may be embodied otherwise without departing from such principles.

What is claimed is:

1. A grinder housing of a pressure chamber grinder comprising: a substantially cylindrical outer mantle, end walls, a plurality of accelerating nozzles passing radially through said outer mantle, each of said plurality of accelerating nozzles forming an obtuse mutual angle with an adjacent accelerating nozzle; a discharge opening in one of said end walls; a centrally located, substantially cylindrical partition wall provided with an inlet opening facing the orifice of each accelerating nozzle terminating at the inner face of the outer mantle, the annular space surrounding the partition wall acting as a gas removing chamber having an exhaust duct passing through the outer mantle for removing a portion of working gas discharged out of solid-working-gas jets of the accelerating nozzles into said gas removing chamber.

2. A grinder housing according to claim 11, wherein: said exhaust duct is provided with a control valve.

3. A grinder housing according to claim 12, wherein: said partition wall includes an inside portion lined with a wear-resistant material.

4. A grinder housing according to claim 3, further comprising an inlet pipe connected to said gas removing chamber for flushing air, said inlet pipe being provided with a control valve.

5. A grinder housing accordingn to claim 4, wherein: said inlet pipe for flushing gas and said exhaust duct for excess working gas are installed at opposite sides of said grinder housing in the center plane between the two accelerating nozzles, the inlet pipe being placed at the side of the largest angle between the accelerating nozzles.

6. A grinder housing according to claim 5, further comprising: a plurality of flushing-air nozzles facing each accelerating nozzle positioned in said gas-removing chamber, each flushing-air nozzle having a first duct substantially following the shape of the flow duct in the accelerating nozzle and a second duct having the shape of a venturi tube and passing across said first duct.

7. A grinder housing according to claim 6, further comprising: a first grinding zone formed in a central part of the grinding chamber for grinding of material, particles of the material issuing out of the accelerating nozzles and colliding against each other; and, a second grinding zone formed at locations of said partition wall opposite orifices associated with the accelerating nozzles.

8. A grinder housing according to claim 7, wherein: said plurality of accelerating nozzles include a first and a second accelerating nozzle positioned with respect to each other at an angle of no more than 170°.

9. A grinder housing of a pressure chamber grinder comprising: a substantially cylindrical outer mantle, a first end wall and second end wall connnected to said mantle; two accelerating nozzles positioned so as to pass through said outer mantle at an obtuse angle with respect to each other; a discharge opening in one of said end walls; a substantially cylindrical partition wall centrally located within said mantle having an inlet opening facing an orifice of each accelerating nozzle, said inlet opening terminating at an inner face of said outer mantle; an annular space between said partition wall and said mantle acting as a gas-removing chamber having an exhaust duct passing through the outer mantle for removing a portion of working gas discharged out of solid-working-gas jets associated with the accelerating nozzles into the gas removing chamber, said inlet pipe and said exhaust duct being positioned at opposite sides of the grinder housing in the center plane between the two accelerating nozzles, the inlet pipe being placed at the side of the largest angle between the accelerating nozzles.

10. A pressure chamber grinder comprising:

a substantially cylindrical outer mantle;

first and second end walls abutting end faces of said mantle, said first and second end walls cooperating with said mantle to define an enclosed space;

first and second accelerating nozzles extending in a radial direction through respective first and second openings in said mantle, said first and second accelerating nozzles being positioned to form an obtuse mutual angle;

a substantially cylindrical partition wall centrally located within said enclosed space, said partition wall enclosing a grinding chamber and cooperating with said outer mantle to form an annular gas-removing chamber between the interior of said mantle and the exterior of said partition wall, first and second inlet openings are provided in said partition wall connecting said grinding chamber with said annular gas removing chamber, said first and second inlet openings spaced from and facing respective first and second orifices of said first and second accelerating nozzles; and, an exhaust duct connected to said annular gas-removing chamber through an exhaust duct opening in said outer mantle, working gas discharged out of solid-working-gas jets associated with said accelerating nozzles passing into said annular gas-removing chamber and through said exhaust duct as solid material particles requiring grinding move along a substantially linear path following a longitudinal axis of the accelerating nozzle into the grinding chamber.

11. A pressure chamber grinder according to claim 10, wherein: said exhaust duct is provided with a control valve to regulate the flow of working gas through said exhaust duct.

12. A pressure chamber grinder according to claim 10, further comprising: a lining of wear-resistant material positioned within the interior of said partition wall.

13. A pressure chamber grinder according to claim 10, further comprising: an inlet pipe connected to said annular gas removing chamber for providing flushing gas to said annular gas-removing chamber, said inlet pipe having a control valve for regulating the flow of flushing gas.

14. A pressure chamber grinder according to claim 10, further comprising: an inlet pipe connected to said gas-removing chamber for providing flushing gas to said gas-removing chamber, said inlet pipe and said exhaust duct being positioned at opposite sides of said outer mantle in a center plane formed between said first and second accelerating nozzles, said inlet pipe being positioned on a side of the largest angle between said first and second accelerating nozzles.

15. A pressure chamber grinder according to claim 10, further comprising: first and second flushing-gas nozzles positioned within said gas-removing chamber, said first flushing-gas nozzle being positioned between said first inlet opening and said first orifice of said first accelerating nozzle and said second flushing-gas nozzle being positioned between said second inlet opening and said second orifice of said second accelerating nozzle, each flushing-gas nozzle having a first duct having a shape and direction substantially the same as a flow duct of said accelerating nozzle and a second duct, having the shape of a venturi tube across said first duct in the direction of said annular gas-removing chamber.

16. A pressure chamber grinder according to claim 10, wherein: grinding of material takes place in a first grinding zone formed in a middle part of said grinding chamber as solid material particles issuing out of said accelerating nozzles collide against each other, and a second grinding zone formed at first and second parts of the partition wall facing associated respective first and second accelerating nozzles.

17. A pressure chamber grinder according to claim 10, wherein: the angle between the accelerating nozzles is less than 170°.

* * * * *